US008337647B1

(12) United States Patent
Davis, Jr.

(10) Patent No.: US 8,337,647 B1
(45) Date of Patent: Dec. 25, 2012

(54) TUFTED GOODS MANUFACTURING METHOD AND OPERATIONAL APPARATUS

(76) Inventor: David M. Davis, Jr., Tunnel Hill, GA (US)

( * ) Notice: Subject to any disclaimer, the term of this patent is extended or adjusted under 35 U.S.C. 154(b) by 373 days.

(21) Appl. No.: 12/503,563

(22) Filed: Jul. 15, 2009

(51) Int. Cl.
*A46D 1/00* (2006.01)

(52) U.S. Cl. ..... 156/72; 156/64; 428/97

(58) Field of Classification Search ..... 156/64, 156/72; 428/97
See application file for complete search history.

(56) References Cited

U.S. PATENT DOCUMENTS 4,035,533 A * 7/1977 Chambley ..... 428/95
6,328,833 B1 * 12/2001 Holeschovsky et al. ..... 156/72
2008/0241458 A1 * 10/2008 Jenkines ..... 428/95

FOREIGN PATENT DOCUMENTS

JP 11276959 A * 10/1999

* cited by examiner

*Primary Examiner* — Katarzyna Wyrozebski Lee
*Assistant Examiner* — Daniel Lee
(74) *Attorney, Agent, or Firm* — Stephen J. Stark

(57) ABSTRACT

The processes of tufting, spraying coating on backing, and setting yarn been provided in a preferred embodiment as a part of a continuous process. The coating is preferably anhydrous with a tack free time of less than two minutes. The yarn setting station employed in many embodiment sets the yarn in a distance of less than about ten feet by injecting air into the yarn side of the tufted goods, preferably with an air knife while the yarns are spread apart.

4 Claims, 3 Drawing Sheets

TUFTED GOODS MANUFACTURING METHOD AND OPERATIONAL APPARATUS

BACKGROUND OF THE INVENTION

This invention relates to the manufacture of tufted goods, including carpet but more preferably artificial grass, preferably including a method of coating the primary backing to lock tufts in position relative to the backing as well as a method of heat treating tufted fibers, preferably in the form of a continuous process together with the tufting process preferably without the product stopping from before tufting to after heat treatment.

FIELD OF THE INVENTION

A typical process of manufacturing carpet and/or artificial grass includes a process of having yarn made at a yarn manufacturer and then shipping the yarn to a tufter who tufts greige goods. From the tufter, the tufted material is then sent often across town to be coated at a coater and then the coated product is ready for even further treatment or shipping on to a customer.

Numerous efforts have been made to spray coating on backing in carpet applications. A popular inexpensive carpet line in the 1970s and 1980s included the process of spraying a foaming polyurethane backing such as those described in U.S. Pat. Nos. 4,515,646 and 4,278,482. More recent attempts include U.S. Patent Applications 2002/0074073 and 2004/0123934.

Additionally, polyurea has been utilized and mixed with polyurethane for fire retardency such as in U.S. Pat. No. 4,374,207 and other foam applications such as U.S. Pat. No. 6,518,348. Other uses of polyurea on reverse side of backing such as is shown and described in U.S. Pat. Nos. 5,045,375 and 4,657,979.

While foam coated backing is certainly an option for some applications, the applicant believes an improved non-foam backing coating is required for many applications. Specifically, a traditional foaming method for coated backing includes the use of an oven. While there have been some attempts made to remove the oven such as is disclosed in U.S. Published Patent Application No. 2004/0123934 and 2002/0074073, at least in some applications a non-foam version of a coated backing is believed to be desirable for many applications.

Removing of or at least reducing the size of the oven is believed to be desirable. If one does not need the oven an at least $1,000,000 capital expense from the coating process can be removed.

In the prior art, yarns are typically set by heating them from the coated side (i.e., opposite from the yarns) in the oven while the coating on the backing is curing. The prior art oven might have a length of up to 100 yards or more and can consume large quantities of energy to maintain temperatures as well as establishing temperatures when starting from cold iron. Heat is typically believed to be applied from the coated side of the backing opposite the yarn along a straight portion of tufted goods at an elevated portion of the oven.

Improvements in providing coated pile goods and setting yarns is believed to be necessary.

SUMMARY OF THE INVENTION

It is an object of the present invention to provide an improved method and apparatus for use in the manufacturer of tufted products.

It is another object of the present invention to provide an improved coating station and method for use in coating tufted goods and particularly artificial grass products.

It is another object of the present invention to provide an improved heat treating process for setting yarn which are preferably not thermoset yarn, but are more particularly thermoplastics, including, but not limited to, nylon, polypropylene, polyethylene, polyester or other yarn types.

In accordance with a presently preferred embodiment of the present invention, backing is fed from the roll towards a tufting machine where it is tufted and possibly accumulated but still deemed fed continuously and uninterrupted (i.e., not cut) before then preferably proceeding on to a coating station. Then the coated yarns possibly continue on to possibly one or more accumulators, and possibly a cutting station, on to a heat setting station whereby the yarns are set. Setting of the yarns preferably occurs in a short distance such as less than 10 feet of travel, less than 3 feet, and more properly set within a narrow length of travel, such as less than 6 inches or width of an air knife. The coated goods with set yarns then proceed on to be punched for water passage and then are possibly sent on for further treatment or delivery.

The coating provided is preferably spray applied with one or more of polyurea and polyurethane in an anhydrous mixture.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
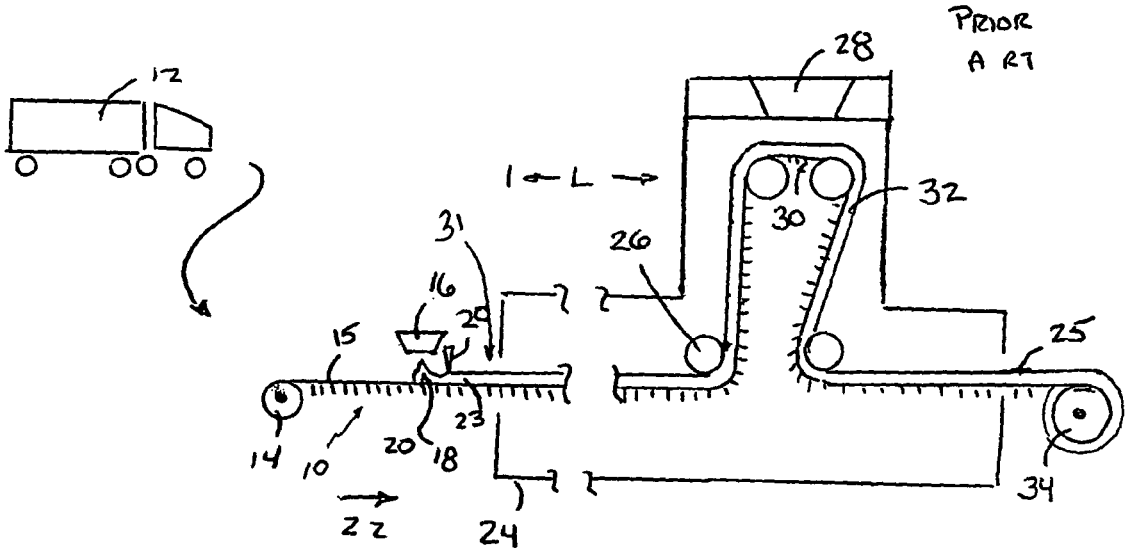
FIG. 1 shows a prior art system of bringing tufted goods after being tufted to be coating on a traditional coating machine.

FIG. 1 shows a diagrammatic representation of a prior art method of coating tufted goods such as carpet and/or artificial grass 10. Tufted goods are provided from a tufter normally in a truck 12 to a coating company that does not tuft goods. The rolls 14 of tufted goods 15 are then provided to a coater at a head 16 which normally deposits a supply of polyurethane 18 on the goods 15. The polyurethane 18 contacts a doctor blade 20 as the tufted goods are fed in direction 22 to provide a desired height of thickness of coating as coated goods 23 to an oven 24.

Oven 24 facilitates curing normally over a length at L which is pretty significant such as at least 100 feet if not 100 yards. After curing a significant period of time and at least then coated goods 25 is brought in contact with roller 26 and upwardly elevated towards heat source 28 which continues to provide heat to the product. At this point in time the yarn fibers 30 are attempted to be set with the heat source 28. Note that the yarn fibers 30 are opposite the coated backing 32 from the yarns 30 along a straight segment 31 of coated goods 23. This is the process as is believed to have been done in Dalton, Ga., by the four major coating companies for many years.

The tufted goods after curing the coating exit the oven 24 as cured goods 25 and are provided on a roll 34. The amount of energy required to run the oven 24 is significant. Curing yarn ovens typically have capital costs which exceed $1,000,000. Furthermore, since many tufters products are at a coater sequentially, competitors can readily see what products and improvements their competitions are bringing to the market.

Figure 2:
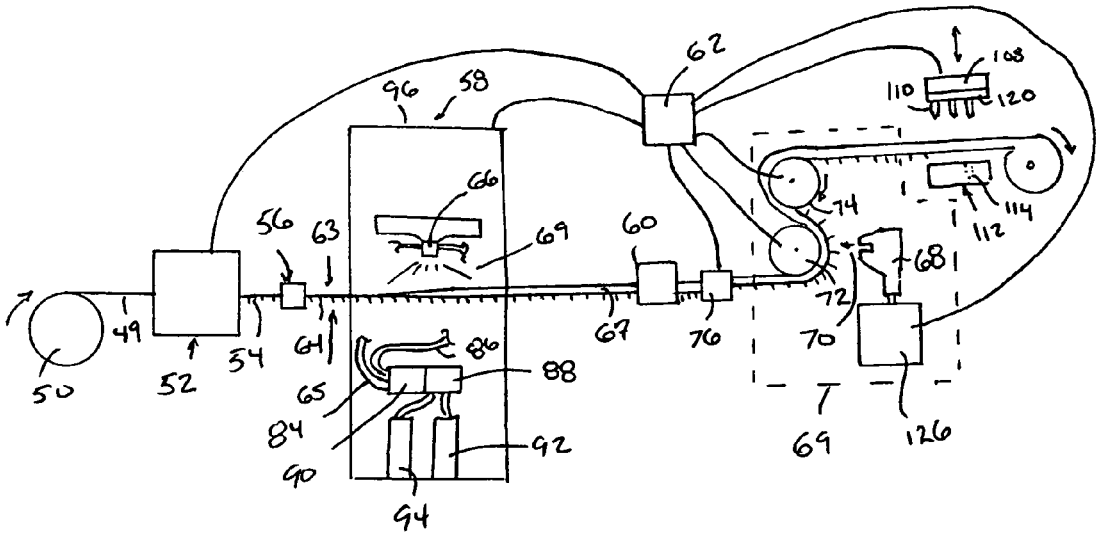
FIG. 2 shows a schematic representation of a presently preferred embodiment of the continuous tufting, coating, heat treating and/or punching method employed by the applicant.
Figure 3:
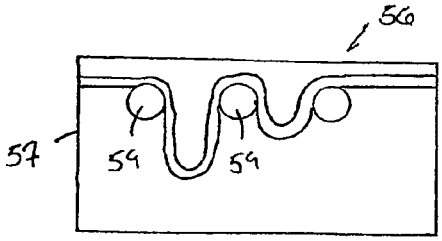
FIG. 3 shows a close up of an accumulator shown in FIG. 2.

FIG. 2 shows an improved apparatus and method for producing tufted goods such as artificial grass, carpet and the like. Specifically, backing 49 is provided on roll 50 and fed through a tufting machine 52 where it is tufted into artificial grass or carpet is tufted goods 54. An optional accumulator 56 of which an embodiment is shown in further detail in FIG. 3 can be employed at least in some embodiments. Many different kinds of accumulators as are known in the art can be as simple as a box 57 with spaced apart rollers 59 as illustrated or more complex such as moving roller systems.

The tufted goods 54 are fed past one or more coating station(s) 58 which applies a coating 67 to the back or reverse side 63 of the primary backing which preferably penetrates backing 49 at least partially into yarn side 65 opposite reverse side 63. Polyurethane and/or polyurea can be utilized in the coating. One or more accumulator(s) 60 may be found downstream. The tufting and coating is preferably part of a continuous process with the backing 49 being continuous from the roll 50 to past the coating station 58 such as past the heat set station 69 and/or the punch 108.

While foaming polyurethane (i.e., formulations of polyol and isocyanate with water) coatings have been employed, the applicant is unaware of attempts at coating non-aqueous solutions of polyol and isocyanate in an effort not to foam as a coating 67 for carpet. In particular, a short cure time such as one limited to a minute to two minutes preferably in an absence of heat to a less than a minute such as less than thirty seconds, possibly when not exposed to heat in a curing oven has been found desirable. In fact, curing time of less than 30 seconds such as three to five seconds has been found satisfactory by the applicant. Longer cure times and cure times in the presence of some heat may be employed in some embodiments.

Although pot life is a second objective as described in U.S. Pat. No. 4,278,482 which is important when dumping polyurethane and then smoothing out with a doctor's blade, this factor is not nearly as important a concern with many embodiments of the applicant's process. The sprayed coating 67 as supplied by the applicant can be applied to a desired thickness such as with use of a controller 62 such as a Program Logic Controller, PLC, which can possibly evaluate the speed of the tufted goods 54 entering the coater 58 as well as the amount sprayed through nozzles 66 to provide a desired thickness of coating. Due to the preferred particularly short cure times, accumulator 60 may be provided downstream in some embodiments. "Tack free times" may be deemed to be interchangeable with "cure times" for this application.

Although no heating is preferably utilized to cure coating, other embodiments may use at least some heat. Minimizing the use of heat is not believed to be taught in the prior art with non-foaming anhydrous polyurethane. If the coatings were to come into contact with themselves at a spaced apart portions of coated tufted goods then substantial issues would be created as the coating would normally be particularly tacky due to the long pot life and cure time. Non-foaming or anhydrous polyurea is also not believed to be utilized in the prior art. Either or both polyurethane and polyurea may be utilized in preferred coatings.

Air knife 68 is shown directing heated gas in between yarn and fibers. Air knife 68 is preferred, but a heat gun or other injection heat source could be employed preferably while the fibers 70 are stretched across one or more rollers 72,74 to set the yarn. By passing the fibers 70 over the rollers 72,74, while injecting heat, the fibers are radially spread apart allowing the heat to penetrate a top surface of the fibers 70. Spreading apart fibers is defined to mean that the distance between the tops of adjacent fibers is greater than those same fibers at the backing (i.e., at the bottom). This could also be employed in other ways such as with a doctor blade contacting the yarn and releasing it or other ways. Spreading apart fibers 70 has been found to assist in more uniform setting of yarn than prior art methods while applying heat.

Although rollers are preferred, other means may be employed to assist in injecting heat into the length of fibers 70. With a nylon yarn, it may be possible to have an original yarn length extending from the backing of one to two inches which may be shortened by a factor of three or more by the setting process with heat. Air knife 68 has been found to work particularly well but other directed or injected heat sources such as heat guns and/or blown heat sources may be provided in other embodiments.

Cutting station 76 may be useful to run a saw blade across the carpet in the event of process stoppage. Controller 62 may provide such a signal. Unless the heat is secured immediately from heat source such as air knife 68, melting yarn may occur by too much exposure to air knife 68 and/or other heat source. Flow of heat such as hot gas or air from air knife 68 may be controlled by controller 62 or another controller. After "setting" the yarn, the yarn is then fed to roll 78 for use as a finished good or for further processing.

Figure 4:
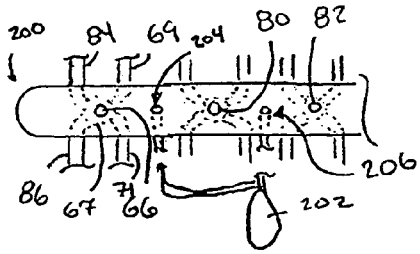
FIG. 4 shows a bottom plan view of the spray head manifold shown in FIG. 2.
Figure 5:
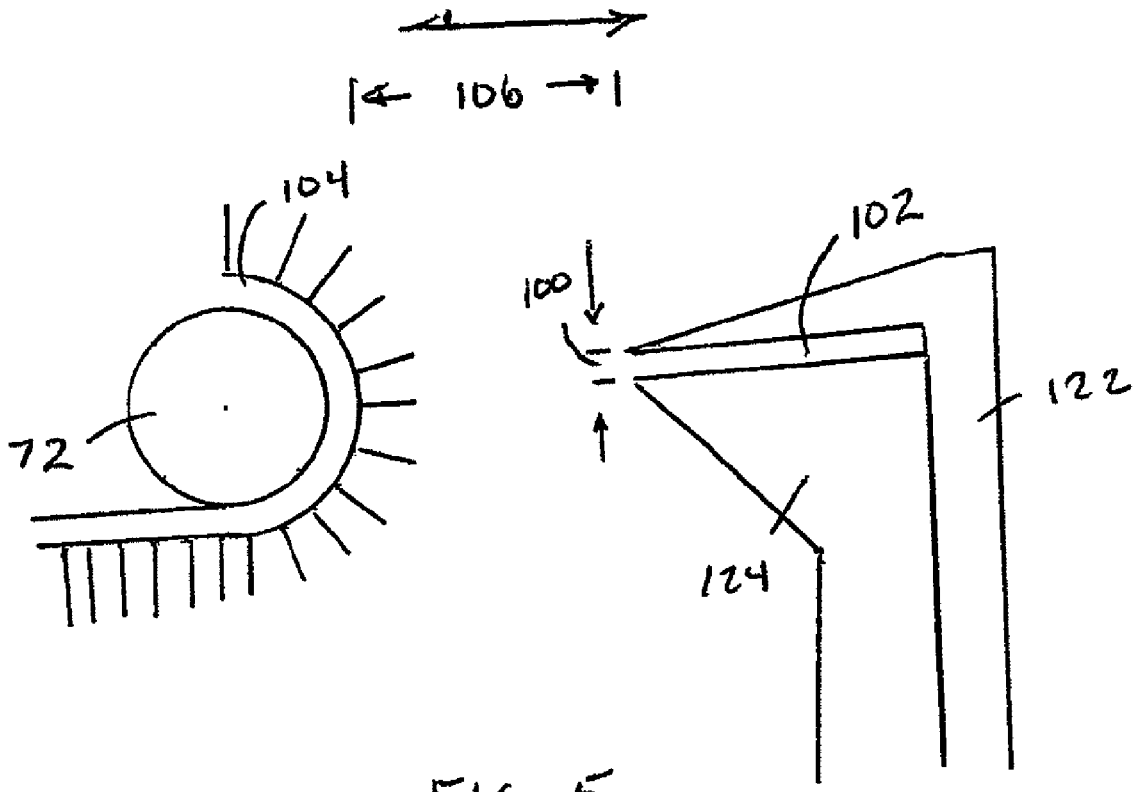
FIG. 5 shows a close up plan view of a portion of the heat setting station shown in FIG. 1.

In the presently preferred embodiment, the nozzles 66 are illustrated in FIG. 2. FIG. 4 shows a plurality of heads or nozzles 66 as can be seen from the bottom showing nozzle heads 66,80,82 which provide a desired spray coverage. Other nozzle systems may be similarly or dissimilarly constructed as those shown in FIG. 2 of U.S. Pat. No. 4,278,482. U.S. Pat. No. 4,760,956 shows another spray gun system which could be incorporated into the manifold 200 of FIG. 4 as would be understood by one of ordinary skill in the art. A chopper 202 or other device could also be employed with this style spray system or others which could chop up, or otherwise dispense fiberglass or other particulate as fed through as is shown in U.S. Pat. No. 4,760,956 and is well known in the art for use in providing discrete particulate in a mold such as in the boat hull making industry.

However, to the applicant's knowledge, no one has attempted to commercially dispense fiberglass and/or other dimensionally stable particulate such as from a chopper 202 to be provided to a manifold 200 or otherwise such as through outlets 204,206 or other structure such as along with spray provided from nozzles 66 or otherwise. In fact, the applicant is unaware of any attempt to provide glass particles, chopped fabric particles, cut dimensional stability particulate or other solid material as discrete portions such as smaller than about ¼×¼×6 inches into a liquid coating 67 before curing such as, but not limited to, chopped fiberglass fabric. In fact, in various embodiments fiberglass or other dimensional stability particulate such as from the cutter 202 or otherwise provided from outlets 204,206 or from other structures can be applied dependently or independently of the spray from nozzles 66 and/or in conjunction with the sprayer nozzle 66 and can be either incorporated as a single manifold 200 or provided on separate manifolds and/or other structures. Cut material, chopped material, yarn material and/or other materials could be utilized as particulate 69. A longest length of material forming particulate 69 is preferred to not exceed six inches, but could be as long as about a foot in some embodiments. Furthermore, if chopped fabric is utilized a size of the discrete particulate is not anticipated to exceed four square inches, but could in some embodiments.

In addition to the use of fiberglass or other glass-based systems, it may be possible to utilize cut up and/or otherwise provide materials as particulate 69, including, but not limited to, scrap such as from the primary backing, secondary backing, yarn such as artificial grass yarn or other scraps that might be available such as latex scraps, urethane scraps, polyurethane scraps, polyurea scraps and/or some or all of the above and still other fabrics such as cotton fabrics or any other fabric and/or particulates such as are believed to impart dimensional stability to the sprayed on coating 67. Other appliances may simultaneously apply particulate 69 on top of the coating 67, and/or alternating with the coating 67 such as if sprayed on or otherwise applied to embed in at least a portion of the coating 67 as applied to the reverse side of the backing from the yarn ends.

A presently preferred embodiment may provide a coating including a non-foaming coating 67. The application of fiberglass or other particulate 69 such as fiber to coating components, particularly when sprayed with the coating onto the tufted goods is believed to be novel regardless of whether or not the coating is foaming or non-foaming. In fact, some applications may provide a foam coating while still others may provide a non-foamed non-aqueously applied coating which does not foam. The coating 67 may, or may not, be applied in a steady manner with bursts, steady stream, or other process of particulate 69 being applied while the spray coating is being applied. Particulate 69 may or may not be applied continuously, or it may be that multiple manifolds such as manifold 200 or other manifold configuration with one or both of nozzles 66 and/or outlets 204,206 or other structures may be provided. A spray may be imparted then particulate 69, then more spray, etc., in still further embodiments. By embedding dimensional stocking particulate 69 at least partially within the coating 67, it is believed that a dimensionally stable tufted good will be produced such as artificial grass or possibly with other tufted goods as well.

Mixtures of non-hydrous polyurethane and/or non-hydrous polyurea as coating 67 have been found successful by the applicant. Specifically, an 80% polyurea, 20% polyurethane blend with the appropriate density and stiffness factor has been found to provide an excellent coating for artificial grass. Seventy/thirty blends could also be used and other blends, such as 90/10 as are known in the art could also be employed. One hundred percent polyurethane could be employed and/or one hundred percent polyurea could be utilized in other embodiments.

Various suitable coatings may be provided. Polycoat Products, Inc., Polyeuro® LP-11 which has a pot life of 14 to 18 seconds, a tack free time of 40-60 seconds. The isocyanates side has a viscosity of 400 to 500 cps while the resin side has a viscosity of 700-900 cps. A density of the mixture is 9.22 pounds per gallon, a hardness of 91 to 83 Shore A, a tensile strength of 2000+−300 psi, an elongation of 300+−50%, a tear strength of 175-200 pli, and a service temperature of −20 to 200° F.

PCS-Protective Coating Solution provides PCS-455 which has a 2-4 second pot life, a tack free time of 10 to 30 seconds, a much lower viscosity such as 120 cps on isocyanates side, and 190 on the resin side. This formulation is lighter with a density of 9.17 pounds per gallon, hardness is 55 Shore D. Tensile strength is higher at 2700+− psi. Elongation is 200+−20%, and tear strength is 400-450 psi. The service temperature is −20 to 250° F. PCS also provides PCS 4-411 which has a pot life of 2-5 seconds, a tack free time of 10-30 seconds. The viscosity is 120 cps on the isocyanates side and 60 cps on the resin side. Density is 9.17 lbs per gallon. Hardness is 50 Shore D. The tensile strength is 2700+−300 psi. Elongation is 225+−20%. Tear is 400+−40 pli.

PCS-482 is another option with a pot life of 3-5 seconds, a tack free of 20-40 seconds, a viscosity of 100+−50, psi on both sides, a density of 9 pounds per gallon and a hardness of 82+−5 Shore A, a tensile strength of 1800+−300 psi, an elongation of 50+−20% and a tear of 250+−40 pli.

In applying the coating with the coater 58, it is understood that the nozzles 66,80,82 are preferably provided with polyol and/or other pre-polymer such one having an amine from one direction such as line 84 and isocyanates and/or diisocynates from line 86. Various additives could also be provided through lines 84 and/or 86. The components then mix at or just before nozzle 66 such as at mixing chamber 67 shown in phantom and are ejected as polyurethane and/or polyurea are ejected from nozzle 66. Purge life 69,71 may be useful to clean mixing chamber 67 and other components after use.

A positive displacement pump such as pump 88 preferably supplies a positive pressure such as about 1500-2100 psi or more. Chemicals are preferably directed through a heater 90 to elevate temperatures such as to about 150°, 155° or 160° Fahrenheit for the polyol and isocyanate to mixing chambers 71 and/or be combined in the nozzles 66,80,82. Drums 92,94 may contain the polyol or pre-polymer and isocyanate and are preferably contained within the ventilation system 96. The pressure provided by pump 88 is preferably at least about 1500 psi and the pressure may need to be at least 1200 depending on whether the coating is subject to blistering of the product.

Although foaming applications of sprayed on polyurethane are known to have been done in the past (i.e., hydrous polyurethane), the applicant is unaware of any attempts at non-foaming polyurethane sprayed on coatings on backing. Specifically, this means that there is no water present in the coating solutions provided by the drums 92,94 through the pump 88 and/or 90 into the lines 84,86 and into the nozzle 56,80,82 etc.

The heat injection device such as air knife 68 as shown in further detail at heat set station 69 can have a slit width 100 as thin as $^{40}/_{1000}$ inches or other appropriate dimension. It can extend through a lateral width of the tufted goods directed through its path or several heat injectors may be employed. From the mouth 102 of knife 68 heat is directed such as at a temperature selected by the user to provide a desired amount of heat. The speed of roller 72 may be a variable effecting injected heat temperature and could be controlled by controller 62. The composition of the tufted fibers 70 such as if they are nylon, polypropylene or other and/or combinations of those or other fibers may also be a variable known to controller 62. The heat source outlet preferably has a slot width 100 of less than 3 feet and preferably more preferably less than an inch. The slot width 100 may be selected and/or adjustable as provided by the manufacturer and possibly controlled by controller 62 such as by moving upper jaw 122 relative to lower jaw 124. Some embodiments, a slot width 100, the speed of the roller 72, and thus the speed of the tufted and coated good 104 can be adjusted such as with controller 62 or otherwise. The heat and/or pressure of the fluid coming from the mouth 102 as from heat supply 126 can also be adjusted in some embodiments such as with controller 62 or otherwise.

Furthermore, the distance 106 of the mouth 102 relative to the roller 72 and/or tufted and coated fabric 104 may also be adjusted. All of which may be controlled by the controller 62 depending on the particular tufted goods to be treated and the particulars of the particular embodiment employed.

Figure 6:
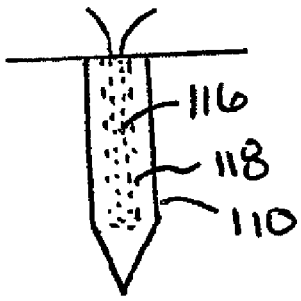
FIG. 6 is a close up of the spikes extending from the punch shown in FIG. 2.

Finally, punch 108 can be employed to punch drain holes through the coated fabric. Other punch assemblies could include rollers with spikes 110 or other appropriate structures. Plate 112 is preferably provided with holes with bores 114, one of which is shown in phantom. Spikes 110 as shown in FIG. 6 include an internal heating element 116. Bottom plate portion 120 may be made of aluminum to assist in the distribution of heat. Internal cartridges 116 are preferably provided with heating elements such as inconnel heating elements.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A method of coating tufted goods comprising the steps of:

providing a tufted good with a yarn side and a backing; and spraying an anhydrous coating comprising polyurea with a sprayer on a reverse side of the backing to provide a coated tufted goods with the coating, and once cured, locking tufts of the yarn at a desired location relative to the backing; wherein the coating has a tack free time less than two minutes in an absence of applied heat;

said sprayer having at least two lines where mix components of the anhydrous coating are mixed proximate to nozzles which discharge a spray of the coating to the backing.

2. The method of claim 1 wherein at least some of the coating penetrates through backing from the reverse side of the backing to the yarn side during the step of spraying.

3. The method of claim 1, further comprising evaluating a speed of the tufted goods with a controller which provides at least an output which controls output of the sprayer.

4. The method of claim 1, wherein the backing is continuously fed from before the tufting machine until after curing of the coating.

* * * * *